US009617032B2

(12) United States Patent
Gamble et al.

(10) Patent No.: US 9,617,032 B2
(45) Date of Patent: Apr. 11, 2017

(54) BAKERY BOXES

(71) Applicants: Tim Wooten Gamble, Charlotte, NC (US); Kathi Levine, Charlotte, NC (US)

(72) Inventors: Tim Wooten Gamble, Charlotte, NC (US); Kathi Levine, Charlotte, NC (US)

( * ) Notice: Subject to any disclaimer, the term of this patent is extended or adjusted under 35 U.S.C. 154(b) by 0 days.

(21) Appl. No.: 15/093,030

(22) Filed: Apr. 7, 2016

(65) Prior Publication Data

US 2016/0297562 A1 Oct. 13, 2016

Related U.S. Application Data

(60) Provisional application No. 62/143,931, filed on Apr. 7, 2015.

(51) Int. Cl.

| | |
|---|---|
| ***B65D 5/50*** | (2006.01) |
| ***B65D 5/02*** | (2006.01) |
| ***B65D 5/10*** | (2006.01) |
| ***B65D 5/42*** | (2006.01) |

(52) U.S. Cl.

CPC ..... *B65D 5/5038* (2013.01); *B65D 5/0254* (2013.01); *B65D 5/10* (2013.01); *B65D 5/4204* (2013.01)

(58) Field of Classification Search

CPC ..... B65D 5/5038; B65D 5/4204; B65D 5/503

USPC ..... 229/120.32, 162.6, 162.7; 206/565, 206/775–778, 781, 782

See application file for complete search history.

(56) References Cited

U.S. PATENT DOCUMENTS

| | | | | |
|---|---|---|---|---|
| 2,162,089 | A * | 6/1939 | Kagen | B65D 5/0254 206/777 |
| 4,530,459 | A * | 7/1985 | Maroszek | B65D 5/46096 229/117.12 |
| 5,289,916 | A * | 3/1994 | Mickelberg | B65D 5/4204 206/478 |
| 5,765,687 | A * | 6/1998 | Matsubara | B65D 5/5038 206/521 |
| 6,296,120 | B1 * | 10/2001 | Danko | B65D 5/503 206/564 |
| 6,446,805 | B1 * | 9/2002 | Mann | B65D 5/46112 206/423 |
| 6,851,601 | B1 * | 2/2005 | Montoya | B65D 5/5038 229/120 |
| 7,303,115 | B1 * | 12/2007 | McClymont | B65D 5/22 206/489 |
| 8,853,601 | B2 * | 10/2014 | Noyelle | B65D 5/5038 219/731 |
| 9,139,359 | B1 * | 9/2015 | Simpson | B65D 85/60 |

FOREIGN PATENT DOCUMENTS

| | | | | |
|---|---|---|---|---|
| WO | WO-00/44631 | A1 * | 8/2000 | B65D 5/5038 |

* cited by examiner

*Primary Examiner* — Gary Elkins

(74) *Attorney, Agent, or Firm* — Shumaker, Loop & Kendrick, LLP

(57) ABSTRACT

Disclosed is a bakery box including an outer box and an insert removably positioned within the outer box.

16 Claims, 7 Drawing Sheets

BAKERY BOXES

CROSS REFERENCE TO RELATED APPLICATION

This U.S. Non-Provisional Patent Application claims priority from U.S. Provisional Patent Application No. 62/143,931 filed on Apr. 7, 2015, the entirety of which is incorporated herein by reference.

TECHNICAL FIELD

The present invention relates generally to the field of boxes and box constructions, and more particularly, to foldable blanks for box constructions adapted for packaging food items such as pastries, breakfast, lunch, and/or dinner items.

BACKGROUND OF THE INVENTION

Boxes can be constructed from an inner layer and an outer layer, in which case it is referred to as a "set up box", also referred to as a "rigid box". The inner layer of a set up box is often formed of a board material, including a paper material. These boxes have numerous purposes, including but not limited to, storing and/or shipping items, and more particularly, certain types of these boxes may be used to house food items, including dessert items. These conventional boxes may be supplied to a customer in assemble form in which a dessert item may be placed. However, problems exist with these conventional boxes. Namely, conventional boxes do not provide for an efficient manner to remove, for example, a dessert item from the box without potentially touching and/or mishandling the dessert item.

BRIEF SUMMARY OF THE INVENTION

Therefore, it is an object of the invention to provide box constructions adapted for packaging dessert items including pastries that concurrently allow for efficient removal of the dessert item from the box without potentially touching the dessert item. More specifically, this box advantageously allows the dessert item to maintain its original form and integrity during transportation and handling.

Disclosed is a box assembly having an outer box with optional transparent windows for viewing the dessert item to be housed therein and an insert configured to receive and/or carry a desert item thereon. The insert further includes handles that allow for removal of the dessert item from the outer box without compromising the integrity of the dessert item. In certain aspects, the insert further includes cut out portions corresponding with and having substantially the same proportions as the transparent windows of the outer box such that the view of the dessert item is unobstructed when a dessert item is placed on the insert and housed within the outer box.

More specifically disclosed is a bakery box, including a first blank configured to fold from coplanar to form an outer box having a bottom, a front, a back, opposing sides, and a top, at least one of which is windowed and covered with a transparent material; and a second blank configured to fold from coplanar to form an insert for being removably positioned within the outer box, the second blank including upwardly foldable handles that align with the opposing sides of the outer box and downwardly extending flanges that elevate a base from the bottom of the outer box, the base configured to hold one or more food items.

In certain aspects, each handle of the second blank includes a side portion and an upper portion in which the side portion of a first handle is configured to extend parallel relative the side portion of a second handle when in use and the side portions of the first and second handles are each configured to be angled relative to the base when in use, and the upper portion of each handle of the second blank is configured to fold inwardly and towards one another such that the upper portions of a first and second handle of the second blank are configured to be substantially parallel to the base of the second blank when in use, and the base of the second blank has a recessed portion or a cavity formed thereon that is adapted to releasably receive and secure one or more food items therein.

In certain aspects, each handle of the second blank is offset relative to and directly laterally adjacent to peripheral edges of the downwardly extending flanges of the second blank.

In certain aspects, each handle and each downwardly extending flange are formed on alternating edges of the base of the second blank.

In certain aspects, the bottom of the first bland/outer box is formed from interlocking portions formed on the front, back, and opposing sides of the first blank.

In certain aspects, at least two of the interlocking portions formed on the front, back, and opposing sides of the first blank have substantially the same shape.

In certain aspects, the opposing sides of the first blank have substantially a same shape.

In certain aspects, the top and front of the first blank are integrally formed such that the top contiguously extends from the front of the first blank.

In certain aspects, the window with transparent material is formed on the front of the first blank and contiguously extends into the top of the first blank.

In certain aspects, the first blank further includes windows with transparent material having substantially the same shape formed on the opposing sides of the first blank such that each window on the opposing sides align with one another when the outer box is assembled.

In certain aspects, at least one securing flap adapted for closing the outer box is formed on the first blank in which the at least one securing flap positioned on at least one of the top, opposing sides, or a combination thereof. For example, the securing flap may be formed only on the top, only on at least one opposing side, or may be formed on each of the top and opposing sides to secure the top of the outer box when in a closed position.

Also disclosed is a bakery box, including an outer box having a bottom, a front, a back, opposing sides, and a top, at least one of which is windowed and covered with a transparent material; and an insert removably positioned within the outer box, the insert including upwardly foldable handles aligned with the opposing sides of the outer box and downwardly extending flanges that elevate a base of the insert from the bottom of the outer box, the base configured to hold one or more food items.

In certain aspects, each handle of the insert includes a side portion and an upper portion in which the side portion of a first handle extends parallel relative the side portion of a second handle and the side portions of the first and second handles are angled relative to the base, and the upper portion of each handle of the insert folds inwardly and towards one another such that the upper portions of the first and second handle of the insert are substantially parallel to the base of the insert, and the base of the insert has a recessed portion or a cavity formed thereon that is adapted to releasably receive and secure one or more food items therein.

In certain aspects, each handle and each downwardly extending flange are formed on alternating edges of the base of the insert.

In certain aspects, the window with transparent material is formed on the front of the outer box and contiguously extends from the front of the outer box to the top of the outer box.

In certain aspects, the outer box further comprises windows with transparent material having substantially the same shape formed on the opposing sides of the first blank such that each window on the opposing sides align with one another.

In certain aspects, the outer box further comprises at least one securing flap adapted for closing the outer box being positioned on at least one of the top, opposing sides, or a combination thereof.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF THE INVENTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

FIGS. 1-5 depict various views of the disclosed outer box 10 and inserts 30. Disclosed is a bakery box 100 including a first blank configured to fold into outer box 10 and a second blank 30 configured to fold to form an insert.

Figure 1:
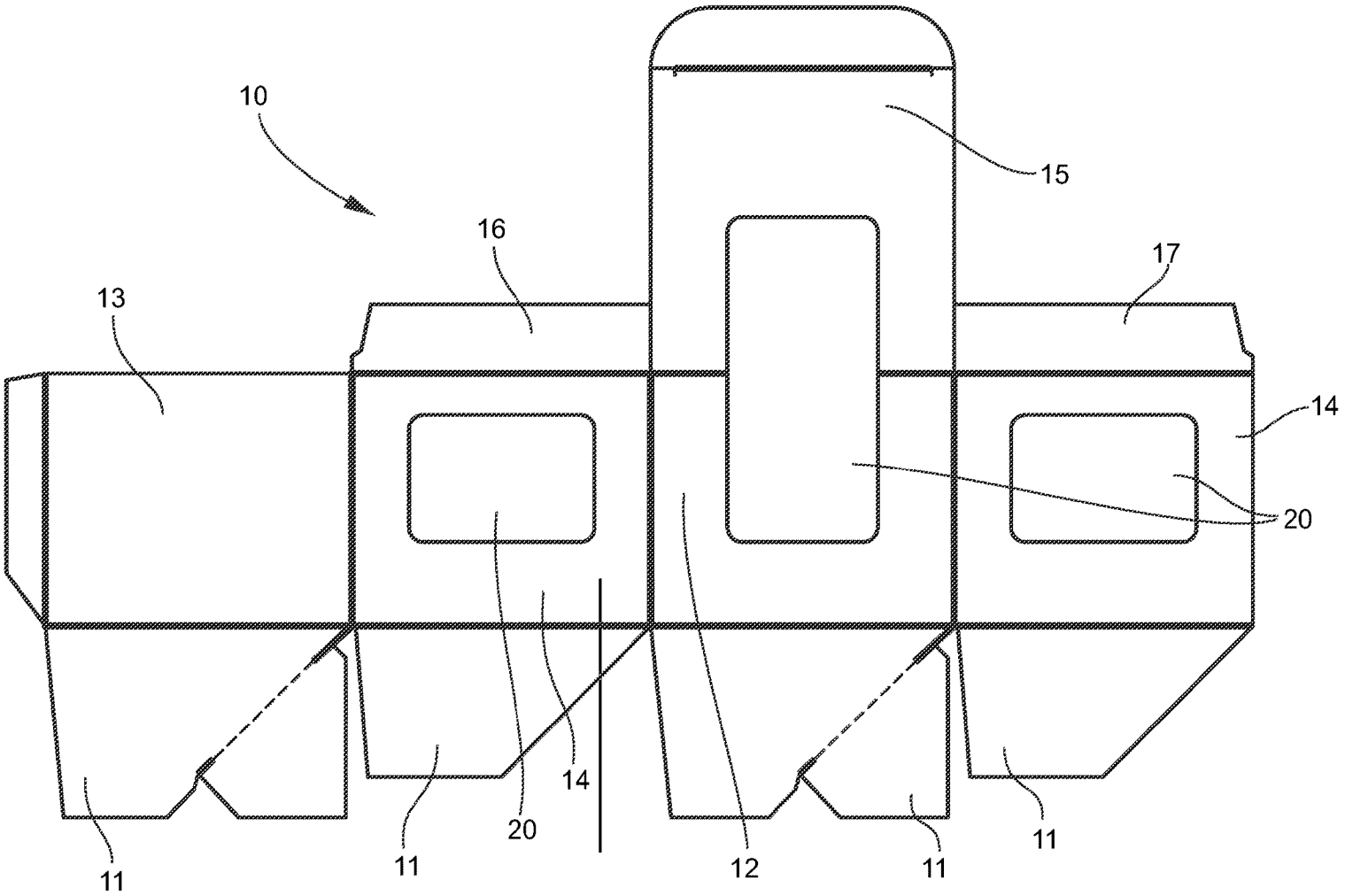
FIG. 1 is a blank that forms an outer box according to an embodiment of the invention.
Figure 4B:
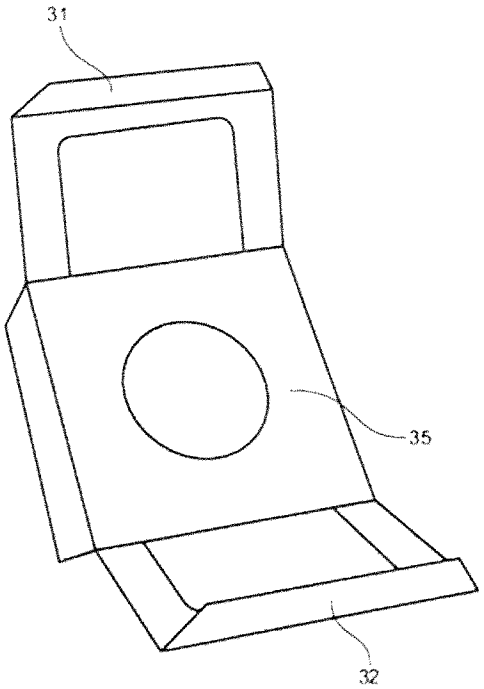
FIG. 4*a* shows an assembled outer box and FIG. 4*b* depicts an assembled insert in which the assembled insert has not been placed in the outer box of FIG. 4A.

FIG. 1 specifically shows the first blank configured to fold from coplanar to form an outer box 10 having a bottom 11, a front 12, a back 13, opposing sides 14, and a top 15, at least one of which is windowed 20 and covered with a transparent material. As shown in FIGS. 1 and 4*b*, the outer box is formed from interlocking portions of the top 15, front, 12, back 13, and opposing sides 14. The top 15, front 12, back 13, and opposing sides 14 each have portions configured to interlock with one another thereby forming the bottom 11 of the outer box. As further shown in FIG. 1, portions that form the bottom 11 may have substantially the same shape. For example, the opposing sides 14 of the first blank have substantially the same shape including portions extending from the opposing sides 14 that form the bottom 11 of the outer box. In certain aspects, at least the portion formed on the front 12 that is configured to interlock to form bottom 11 has perforations positioned diagonally relative to the longitudinal axis of the top 15/front 12, which further aids in the foldability and interlocking features that form bottom 11. In certain aspects, the outer box is formed of a sufficiently rigid material including, for example, a paper material such as cardboard and/or corrugated cardboard.

Figure 4A:
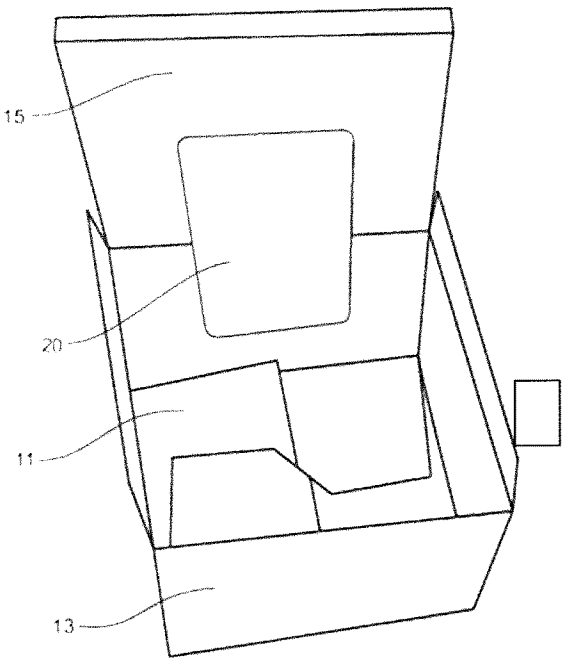

As shown in FIGS. 1 and 4*a*, at least one window 20 is present in outer box 10 and further includes transparent material that may include a transparent plastic adhered or fixably attached to the inner surface of the outer box. The transparent material preferably allows one to view the internal contents of the bakery box 100. For example, as shown in FIG. 1, the window 20 with transparent material is formed on the front 12 of the first blank and contiguously extends into the top 15 of the first blank. FIG. 4*a* provides an additional view of these features when the outer box is assembled. As further shown in FIG. 1, the first blank can includes windows 20 with transparent material having substantially the same shape formed on the opposing sides 14 of the first blank such that, as shown FIGS. 4*a* and 5, each window on the opposing sides 14 align with one another when the outer box is assembled.

Figure 2A:
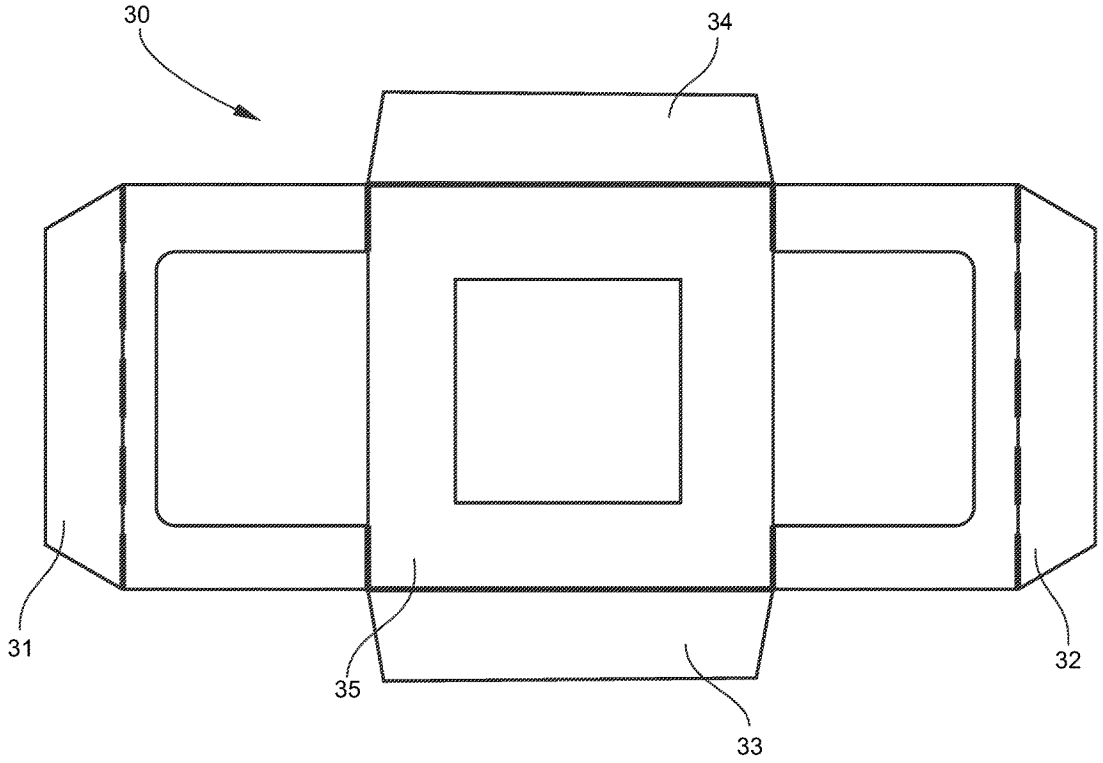
FIG. 2*a* and FIG. 2*b* are exemplary insert blanks adapted for being assembled and removably positioned within the outer box.
Figure 2B:
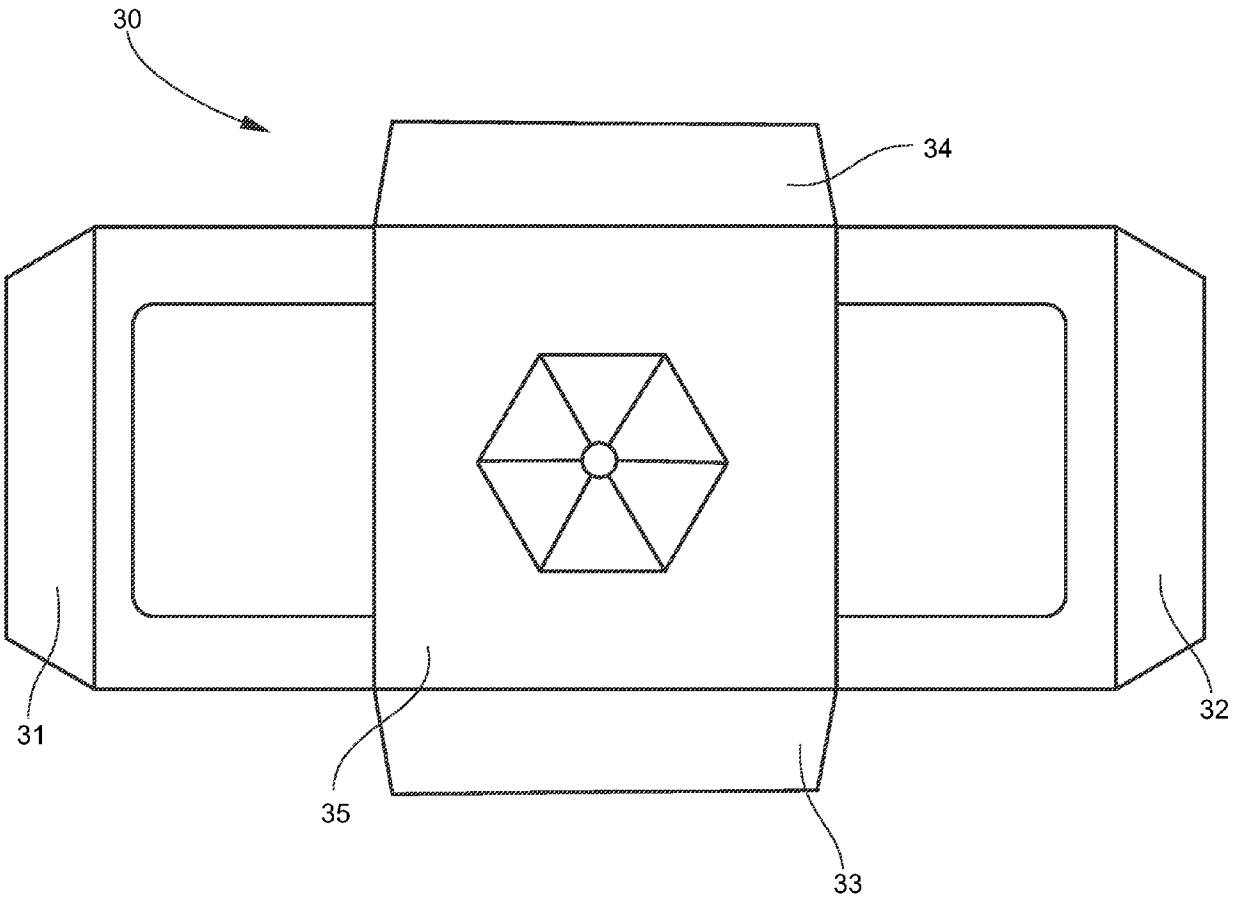
Figure 3A:
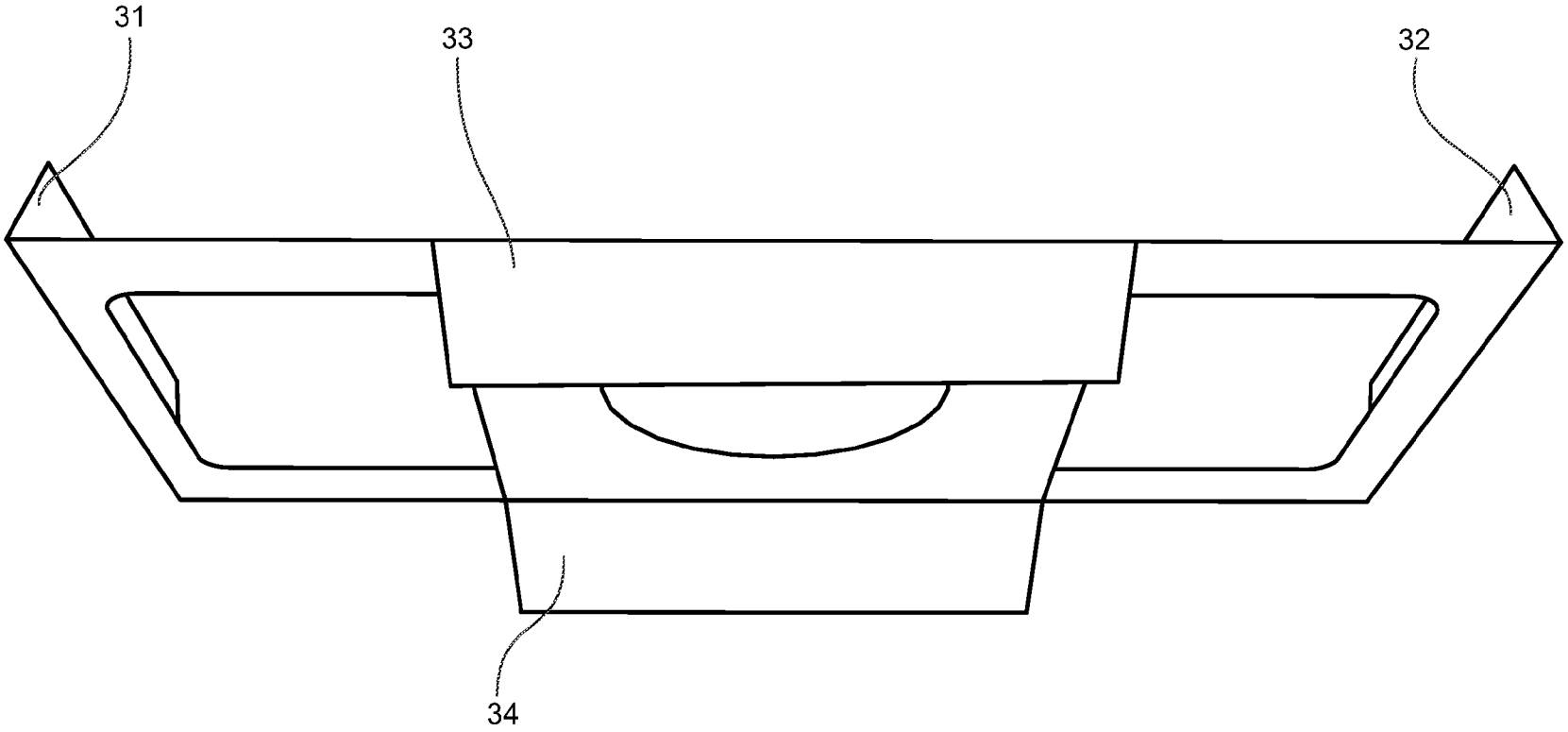
FIG. 3*a* shows the assembled insert.
Figure 3B:
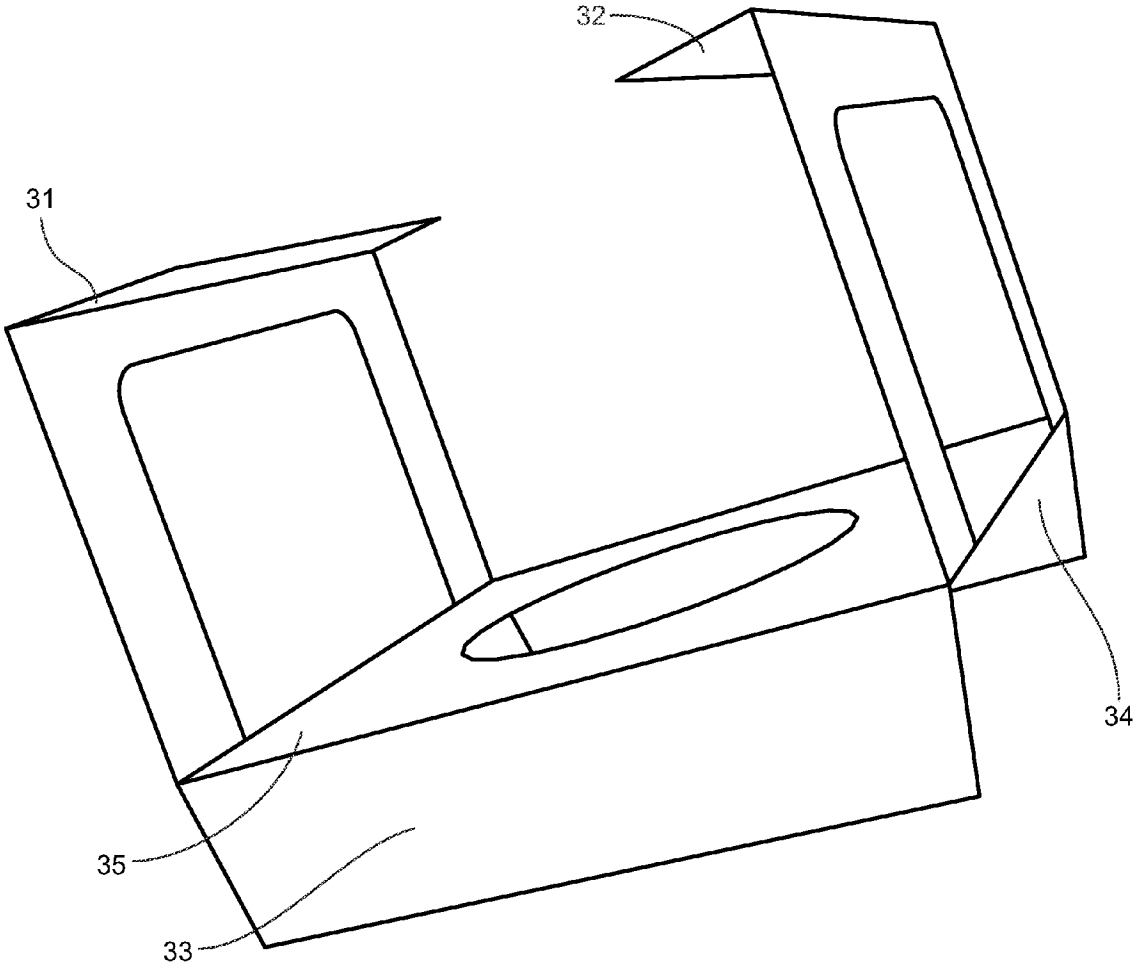
FIG. 3*b* shows a user's hand gripping the insert handles for moving the insert to a desired location.
Figure 5:
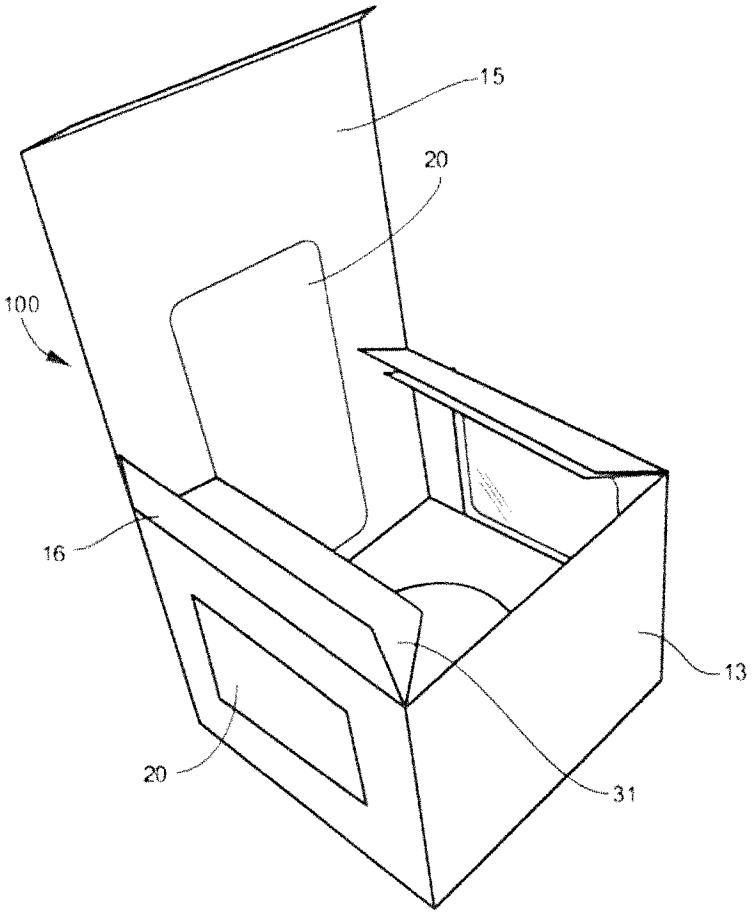
FIG. 5 shows an assembled outer box with an insert placed therein.

The second blank 30 is configured to fold from coplanar to form an insert for being removably positioned within the outer box, the second blank including upwardly foldable handles 31, 32 that align with the opposing sides 16, 17 of the outer box and downwardly extending flanges 33, 34 that elevate a base 35 from the bottom of the outer box 10 when fully assembled as the bakery box 100 shown in view of FIG. 3*b* and FIG. 5. As shown in FIGS. 2*a*, 2*b*, and 5 the base 35 may be altered to include a circular cut-out, a square cut-out, and/or a hexagonal shape depending on the desired food item being placed on the base. In certain aspects, the base 35 may be configured to hold one or more food items including, for example, cupcakes, pastries, or other dessert items.

FIG. 3*a* shows the assembled insert 30 with the handles having side portions being coplanar, in a position in which the insert is not in use, and FIG. 3*b* shows the insert being ready for use in which each handle 31, 32 of the insert includes a side portion and an upper portion in which the side portion of a first handle 31 extends parallel relative the side portion of a second handle 32 and the side portions of the first and second handles are angled relative to the base 35, and the upper portion of each handle of the insert folds inwardly and towards one another such that the upper portions of the first and second handle of the insert are substantially parallel to the base 35 of the insert, and the base of the insert has a recessed portion or a cavity formed thereon that is adapted to releasably receive and secure one or more food items therein.

FIG. 4 shows an assembled outer box 10 having top 15 in an opened position and with an assembled insert 30 that has yet not been placed in the outer box.

FIG. 5 shows an assembled bakery box 100 having an outer box 10 with an insert 30 placed therein. FIG. 5 further depicts window 20 being position on front and top 15 in which the window is formed on the front of the outer box and contiguously extends from the front onto the top 15 of the outer box. FIG. 5 further shows window 20 positioned on the opposing sides. FIGS. 2*a*, 2*b*, and 3*b* further depict additional exemplary inserts 30 having different shaped cut-outs within base 35 (e.g., recessed portions and/or cavities formed on the base being adapted to releasably receive and secure one or more food items therein); these two additional inserts are shown outside bakery box 100 and are interchangeable with the insert shown positioned in the outer box of FIG. 5.

Bakery box 100 provides for numerous advantages over conventional bakery boxes including, but not limited to, providing a means for efficient removal of a dessert item from the box without potentially touching the dessert item and advantageously allowing the dessert item to maintain its original form and integrity during transportation and handling. Bakery box 100 is also inexpensive to manufacture. Thus, bakery box 100 provides an economical and highly sanitary alternative to the currently known bakery boxes in which the probability of mishandling, for example, a dessert item is highly reduced and/or may be completely avoided.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. A pair of blanks for forming a bakery box comprising:

a first blank configured to fold from coplanar to form an outer box having a bottom, a front, a back, opposing sides, and a top, at least one of which is windowed and covered with a transparent material; and a second blank configured to fold from coplanar to form an insert for being removably positioned within the outer box, the second blank including upwardly foldable handles that align with the opposing sides of the outer box and downwardly extending flanges that elevate a base of the insert from the bottom of the outer box, the base configured to hold one or more food items, wherein:

each handle of the second blank includes a side portion and an upper portion connected by a fold line in which the side portion of a first handle is configured to extend parallel relative the side portion of a second handle when in use and the side portions of the first and second handles are each configured to be angled relative to the base when in use, the upper portion of each handle of the second blank is configured to fold inwardly along a fold line and towards one another such that the upper portions of a first and second handle of the second blank are configured to be substantially parallel to the base of the second blank when in use, and the base of the second blank has a recessed portion or a cavity formed thereon that is adapted to releasably receive and secure one or more food items therein, and at least one of the first handle or second handle includes an opening configured to align with the window of the first blank such that the one or more food items may be viewed through both the opening of the at least one of the first handle or second handle and the window of the first blank.

2. The pair of blanks for forming a bakery box of claim 1, wherein each handle of the second blank is offset relative to and directly laterally adjacent to peripheral edges of the downwardly extending flanges of the second blank.

3. The pair of blanks for forming a bakery box of claim 2, wherein each handle and each downwardly extending flange are formed on alternating edges of the base of the second blank.

4. The pair of blanks for forming a bakery box of claim 3, wherein the bottom is formed from interlocking portions formed on the front, back, and opposing sides of the first blank.

5. The pair of blanks for forming a bakery box of claim 4, wherein at least two of the interlocking portions formed on the front, back, and opposing sides of the first blank have substantially a same shape.

6. The pair of blanks for forming a bakery box of claim 5, wherein the opposing sides of the first blank have substantially a same shape.

7. The pair of blanks for forming a bakery box of claim 6, wherein the top and front of the first blank are integrally formed such that the top contiguously extends from the front of the first blank.

8. The pair of blanks for forming a bakery box of claim 7, wherein the window with transparent material is formed on the front of the first blank and contiguously extends into the top of the first blank.

9. The pair of blanks for forming a bakery box of claim 8, further comprising windows with transparent material having substantially the same shape formed on the opposing sides of the first blank such that each window on the opposing sides align with one another when the outer box is assembled.

10. The pair of blanks for forming a bakery box of claim 9, further comprising at least one securing flap adapted for closing the outer box, the at least one securing flap positioned on at least one of the top, opposing sides, or a combination thereof.

11. A bakery box, comprising:

an outer box having a bottom, a front, a back, opposing sides, and a top, at least one of which is windowed and covered with a transparent material; and an insert removably positioned within the outer box, the insert including upwardly foldable handles aligned with the opposing sides of the outer box and downwardly extending flanges that elevate a base of the insert from the bottom of the outer box, the base configured to hold one or more food items, wherein:

each handle of the insert includes a side portion and an upper portion in which the side portion of a first handle extends parallel relative the side portion of a second handle and the side portions of the first and second handles are angled relative to the base, and the upper portion of each handle of the insert folds inwardly and towards one another such that the upper portions of the first and second handle of the insert are substantially parallel to the base of the insert, and the base of the insert has a recessed portion or a cavity formed thereon that is adapted to releasably receive and secure one or more food items therein.

12. The bakery box of claim 11, wherein each handle and each downwardly extending flange are formed on alternating edges of the base of the insert.

13. The bakery box of claim 12, wherein the window with transparent material is formed on the front of the outer box and contiguously extends from the front of the outer box to the top of the outer box.

14. The bakery box of claim 13, further comprising windows with transparent material having substantially the same shape formed on the opposing sides of the first blank such that each window on the opposing sides align with one another.

15. The bakery box of claim 14, further comprising at least one securing flap adapted for closing the outer box being positioned on at least one of the top, opposing sides, or a combination thereof.

16. The bakery box of claim 11, wherein at least one of the first handle or second handle of the insert includes an opening configured to align with the window of outer box such that the one or more food items may be viewed through both the opening of the at least one of the first handle or second handle of the insert and the window of the outer box.

* * * * *